United States Patent [19]

Hastings

[11] Patent Number: 4,516,464

[45] Date of Patent: May 14, 1985

[54] VALVELESS TRUMPET INSTRUMENT

[76] Inventor: John H. Hastings, 591 Elmgrove Rd., Rochester, N.Y. 14606

[21] Appl. No.: 440,798

[22] Filed: Nov. 12, 1982

[51] Int. Cl.[3] ..... G10D 7/10

[52] U.S. Cl. ..... 84/387 R; 84/396

[58] Field of Search ..... 84/387–401

[56] References Cited

U.S. PATENT DOCUMENTS

| | | | |
|---|---|---|---|
| D. 69,905 | 4/1926 | Mussehl | 84/387 X |
| 1,122,207 | 12/1914 | Kloepfel | 84/387 |
| 3,529,505 | 9/1970 | Brooks | 84/387 |

FOREIGN PATENT DOCUMENTS

| | | | |
|---|---|---|---|
| 471762 | 2/1929 | Fed. Rep. of Germany | 84/395 |
| 47280 | 6/1909 | Switzerland | 84/387 |
| 2766 | of 1858 | United Kingdom | 84/387 |
| 235083 | 6/1925 | United Kingdom | 84/387 |

*Primary Examiner*—Lawrence R. Franklin

*Attorney, Agent, or Firm*—Shlesinger, Fitzsimmons & Shlesinger

[57] ABSTRACT

Each of seven modified trumpet tubes is connected by a series of tubular "Y" connections to a single, conventional mouthpiece. Each modified tube is similar to a conventional trumpet except that its three manually-operated finger valves and associated valve slides have been replaced by a single, generally U-shaped tubular slide, which is slidably mounted on the outer end of the usual loop which is formed in the trumpet tubing. The slides are of slightly different lengths, and each is adjusted so that the overall effective axial length of each trumpet tube (from the mouthpiece to its bell) is equal to one of the seven different tube lengths, which are required to produce the seven different semitones capable of being produced by a conventinal trumpet. The entire chromatic trumpet range can be played simply by applying proper lip vibrations to the mouthpiece. The several "Y"-shaped connections form part of a single, tubular fitting interposed between the mouthpiece and trumpet tube, and having smoothly tapering bores which are preferably rectangular in cross section.

15 Claims, 3 Drawing Figures

10
54"
64.5"
57.4"
61.1"
68.4"
72.1"
75.6"
60°
30°
d

VALVELESS TRUMPET INSTRUMENT

BACKGROUND OF THE INVENTION

This invention relates to brass horns, and more particularly to a novel instrument comprising seven individual trumpets which are interconnected to a single mouthpiece. Even more particularly this invention relates to a novel tubular fitting or manifold comprising a system of "Y" connectors for connecting a plurality of valveless trumpets to a single mouthpiece, so that the entire chromatic trumpet range can be played on the instrument solely by virtue of the lip vibrations applied to the single mouthpiece.

A conventional trumpet comprises a brass tube having intermediate its ends a looped section that is provided with three, manually-operable finger valves, which function selectively to extend the effective length of the trumpet tube and consequently the length of the air column which is vibrated when the trumpet is played. Typically, when the second valve (counting from the mouthpiece of the horn) is pushed down or "fingered", it adds tubing which shifts the frequency of the vibrating air column down one semitone. When the first valve (1) is pushed downwardly it effectively adds an amount of tubing which causes the frequency to be shifted down two semitones, or one whole tone. When both the first and second valves (1 and 2) are moved downwardly, they provide a downward shift of three semitones, or a minor third. The third valve (3), when moved downwardly alone, also adds an amount of tubing sufficient to shift the frequency down approximately three semitones, whereby valves 2 and 3 lower the horn four semitones when fingered; valves 1 and 3 lower it five semitones; and all three valves, when pushed down, lower it six semitones relative to the normal tone which will be achieved when all three valves are up.

In practice, therefore, the three valves on a trumpet permit the effective length of its tube or air column (i.e., the overall axial length of the tube from the mouthpiece to the bell) to have seven different values ranging from the shortest, as when all three valves are up or open, to the longest, which is equivalent to having all three valves pushed downwardly to their operative positions. Specifically, the linear values of the seven different effective lengths of the trumpet and the corresponding "down" positions of its respective valves 1, 2 and 3 required to produce these lengths are set forth in the following table:

TABLE I

| LENGTH | INCHES | CM. | VALVES |
|---|---|---|---|
| No. 1 | 54.0 | 137.0 | 0 |
| No. 2 | 57.4 | 145.8 | 2 |
| No. 3 | 61.1 | 155.1 | 1 |
| No. 4 | 64.5 | 163.9 | 1, 2 |
| No. 5 | 68.4 | 173.8 | 2, 3 |
| No. 6 | 72.1 | 183.1 | 1, 3 |
| No. 7 | 75.6 | 191.9 | 1, 2, 3 |

With perseverance and practice, it is of course possible for the average person to learn to play, if not to master, the conventional trumpet. This, however, presupposes one's ability to manipulate the three valves which are used to control the tones of the trumpet. Certain handicapped persons would not be able to manipulate such valves, and therefore could be precluded from learning to play the trumpet. Heretofore efforts have been made to provide trumpets which could be played by such individuals. U.S. Pat. No. 2,358,605, for example, discloses a foot-operable attachment for manipulating the valves of an instrument such as a trumpet, thus permitting the instrument to be played by one who is otherwise handicapped from being able to manipulate the valves with his or her fingers.

It is an object of this invention, therefore, to provide a valveless trumpet-type instrument which is capable of being played solely by virtue of lip vibrations applied to its mouthpiece.

A further object of this invention is to provide a novel brass horn, which is the equivalent of seven trumpets connected to a common mouthpiece, and disposed to produce, solely in response to lip vibrations on said mouthpiece, the seven semitones associated with the conventional trumpet.

A more specific object of this invention is to provide a novel horn comprising seven different valveless trumpets which are connected to a common mouthpiece by a series of tubular "Y" connections of predetermined configuration.

Other objects of this invention will be apparent hereinafter from the specification and from the recital of the appended claims.

SUMMARY OF THE INVENTION

Seven different trumpets, each of which has had its three valves replaced by a length of adjustable tubing, are connected by a series of tubular "Y" connectors to a common mouthpiece of conventional design. By adjusting its tubular extension each of the seven trumpets can be preset to have an overall effective length (i.e., the distance from the mouthpiece to its bell) corresponding to one of the seven tube lengths that are necessary to provide the seven different semitones associated with a conventional trumpet. Preferably the fitting or manifold forming the "Y" connections between the mouthpiece and the inlet ends of the seven different trumpet tubes is rigid, and its tubular passages are carefully tapered so that turbulence or abrupt changes in the energy imparted to the air column in the horn are minimized during operation of the horn.

In a preferred embodiment of the invention the "Y" connections in the manifold, which connects the mouthpiece to the respective trumpet tubes, are rectangular in cross section except in those areas where the connections merge with the mouthpiece and the inlets to the trumpet tubes. Specifically, the mouthpiece tapers from circular to rectangular in cross section at the stem or inlet of the manifold, and each of the seven different outlets of the series of "Y" connectors tapers from a rectangular to a circular cross section where they merge with the respective trumpet tube inlets.

THE DRAWINGS

DETAILED DESCRIPTION OF THE PREFERRED EMBODIMENTS

Figures 1, 2, 3:
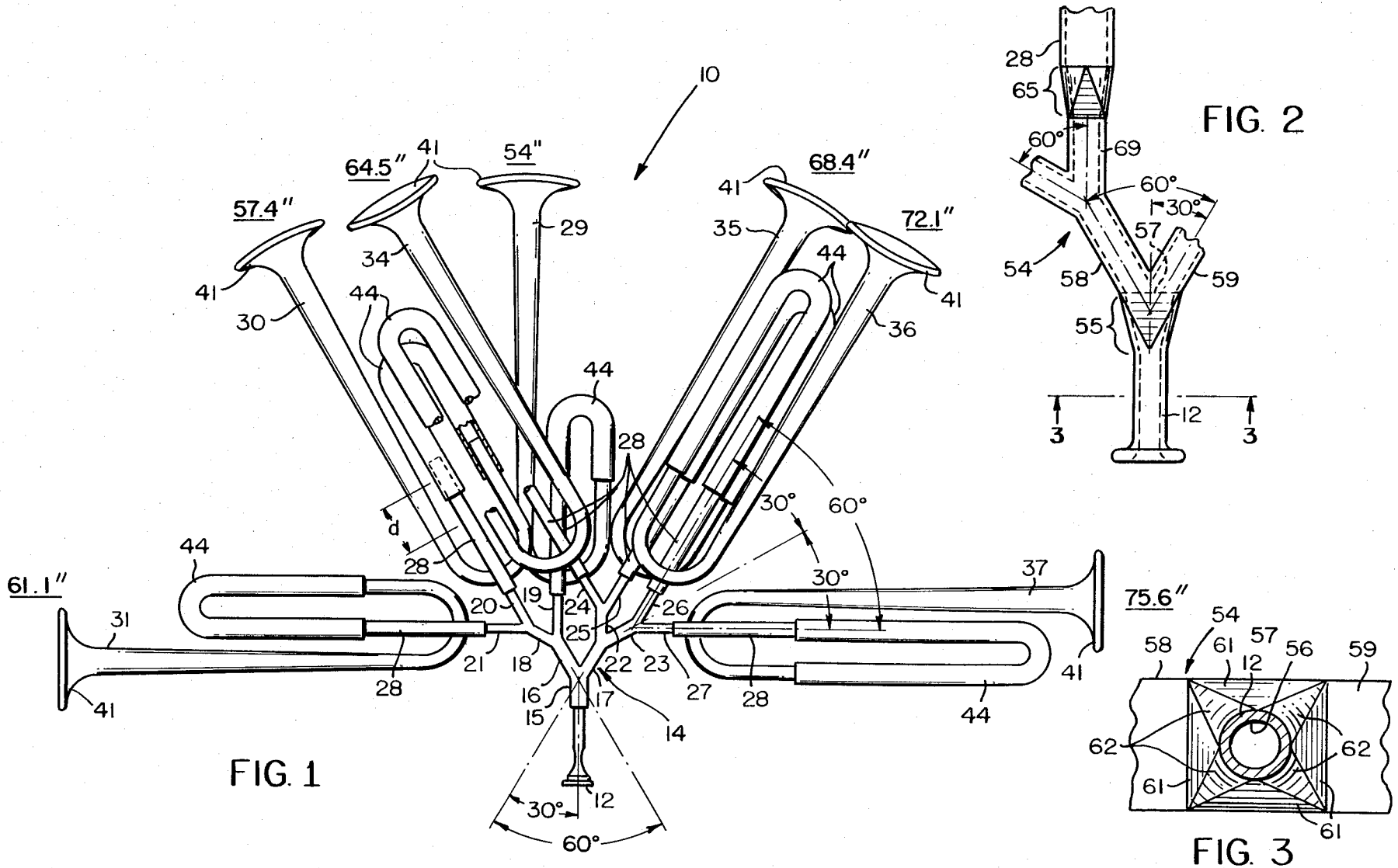
FIG. 1 is a fragmentary plan view of a novel horn made according to one embodiment of this invention, and illustrating a conventional mouthpiece connected by a tubular manifold to each of seven different valveless trumpet tubes.
FIG. 2 is a fragmentary plan view similar to FIG. 1, but showing a modified form of mouthpiece and tubular manifold which may be used with this invention.
FIG. 3 is an enlarged fragmentary sectional view taken generally along the line 3—3 in FIG. 2 looking in the direction of the arrows.

Referring now to the drawings by numerals of reference, and first to FIG. 1, 10 denotes generally a brass horn comprising a conventional, metal mouthpiece 12 which may be of the type that normally forms part of a standard trumpet. The output end of mouthpiece 12 is releasably secured in the tubular stem portion 15 of a rigid "Y" connector or manifold which is denoted generally by the numeral 14. At its end opposite the mouthpiece 12 the stem 15 divides or splits into two, divergent, tubular passages 16 and 17, the center lines of which lie in a plane containing the common axis of the mouthpiece 12 and stem 15. The axes of passages 16 and 17 also are angularly spaced 60° from each other, and 30°, respectively, from the common axis of mouthpiece 12 and stem 15. At its end remote from the stem 15 the passage 16 is split into two further, divergent tubular passages 18 and 19; and at its end remote from passage 16 the passage 18, in turn, divides or separates into two other divergent, tubular passages 20 and 21, respectively.

At its end remote from the stem 15 the tubular passage 17 is split or divided into two, divergent, tubular passages 22 and 23; and in turn, at their ends remote from passage 17 passage 22 is divided into two divergent, tubular passages 24 and 25, respectively, and passage 23 is divided into the two divergent passages 26 and 27, respectively. It is to be understood that the center lines of the stem portion 15 and each of the passages 16 through 27 lie in a common plane. Moreover,at each "Y" shaped intersection where a respective trunk or passage 16, 17, 18, 22 or 23 diverges or splits into two divergent passages, the latter are spaced at an angle of 60° to each other and at 30° to the center line of the associated trunk from which they diverge.

The discharge ends of the tubular passages 19, 20, 21, 24, 25, 26 and 27, respectively, are secured, in place of the usual mouthpiece, in the inlet ends of the tubes 28 of seven different trumpets, which are denoted by the numerals 29, 30, 31, 34, 35, 36 and 37, respectively. Intermediate its ends the tube 28 of each trumpet is looped in the usual manner, and terminates at its outer end in the usual bell 41. In the embodiment illustrated each of the seven trumpets differs from the usual trumpet by virtue of the fact that the three manually-operated valves and associated valve slides, which are usually employed in a conventional trumpet, have been eliminated and replaced by a single, adjustable, generally U-shaped slide 44, which forms the outer end of each trumpet loop.

In practice each of the slides 44 is adjusted or preset so that the overall effective axial length of the air passage through a respective trumpet (i.e., from the mouthpiece 12 to its bell 41) will have a predetermined value; and specifically, one of the values corresponding to those necessary to produce the seven semitones of a conventional trumpet. The slide 44 for the trumpet 29, for example, is adjusted so that the overall axial length of the tubular passage from the mouthpiece 12 through the trumpet 29 to its bell 41 will be approximately 54 inches, as denoted in FIG. 1. The slides 44 for the remaining trumpets 30, 31, 34, 35, 36 and 37 are also adjusted until the effective axial lengths of the air passes through these trumpets from the mouthpiece 12 through their bells 41 are, respectively, 57.4 inches, 61.1 inches, 64.5 inches, 68.4 inches, 72.1 inches and 75.6 inches, also as denoted in FIG. 1. With the slides 44 thus adjusted, each of the associated trumpets will correspond to a different one of the seven valve positions or fingerings of a conventional trumpet, and as noted hereinafter, will therefore be capable of producing the corresponding seven semitones which a single, conventional trumpet is capable of producing.

In use, when the slides 44 have been preset as noted above, no further adjustments should be necessary. The performer need only to apply the proper lip vibrations to the mouthpiece 12, and in so doing should be able to play the entire chromatic trumpet range solely through lip vibration. When the lips play a note on the mouthpiece 12, the trumpet or trumpets which have a resonance close to that of the fundamental frequency of that particular note will resonate at that fundamental frequency. The harmonics, which are also produced with that particular note, will resonate in the trumpet or trumpets which have a resonance made close to any individual harmonic.

In the embodiment illustrated in FIG. 1 it will be noted that the trumpet 29, which has the shortest effective length, has the inlet end of its tube 28 attached to the passage 19 that communicates directly with one of the legs (passage 16) of the first "Y" split in the fitting 14. This contrasts with the tubes 28 of the remaining trumpets, which are indirectly connected to one of the legs 16 or 17 of the first "Y" split through one of the passages 18, 22 and 23, respectively. Moreover, the U-shaped slides 44 are of different lengths, the shortest being mounted on horn 29 and the longest on horn 37. Each slide, furthermore, is mounted for limited adjustment on its associated horn, for example within the distance d as shown in FIG. 1, which in practice may be approximately five inches.

It should be noted also that while each of the seven trumpets in this first embodiment has been modified by removing its three finger-operated valves and associated pieces of tubing and replacing them with the slides 44, the horn 10 could be made instead simply by connecting the inlet ends of the tubes of each of seven conventional trumpets to the common mouthpiece 12, provided that each trumpet would have its three valves secured in one of the seven different fingering combinations that are required to produce the above-noted seven different semitones. As still another alternative, the valveless trumpet tubes in FIG. 1 could be made of the seven specific lengths denoted in this Fig., rather than using the slides 44 to achieve such lengths.

Referring now to FIGS. 2 and 3, wherein like numerals are employed to denote elements similar to those employed in the first embodiment, 54 denotes generally a modified "Y" connector or manifold which is adapted to be employed with the valveless trumpets of FIG. 1 in place of the fitting 14. In this embodiment the fitting 54 has a modified stem portion 55, which extends between the inner end of the circular mouthpiece 12 and the first "Y" split or branch connection in the fitting. At the end thereof which merges with the mouthpiece 12 the stem 55 has a circular bore 56 which from that point tapers on expands and gradually changes its cross sectional configuration to a rectangular configuration at the point 57 where the bore diverges to form the first "Y" connection denoted by the two divergent passages 58 and 59. In the second embodiment, however, the passages 58 and 59, which correspond to the passages 16 and 17, respectively, in the first embodiment, are rectangular in cross section.

In a like manner, the remaining passages in the fitting 54, which diverge ultimately to form the seven different outlets corresponding to the outlets 19, 20, 21, 24, 25, 26 and 27 in the first embodiment, are also rectangular in cross section. The first of these outlets is denoted at 69 in FIG. 2, and corresponds to the outlet 19 in the embodiment shown in FIG. 1. In addition to differing from the outlet 19 by virtue of the fact that it is rectangular in cross section, outlet 69 is connected to the inlet end of the tube 28 of the first trumpet 29 by a tubular transition section 65, which is the inverse of the stem section 55. Specifically, the transition section 65 has a bore which is rectangular in cross section at the point where the section merges with passage 69; and from this point the bore of the section 65 diverges and gradually alters its configuration to a completely circular configuration at the point where sections 65 merges with the inlet end of the tube 28 of trumpet 29. Although the remaining outlets of the fitting or manifold 54 are not shown in detail, it will be understood that each such outlet is connected to the tube 28 of the associated trumpet 30, 31, 34, 35, 36 and 37 but a transition section similar to that denoted by numeral 65.

As shown in FIGS. 2 and 3, the outer peripheral surface of the stem section 55 of fitting 54 has formed thereon opposed, triangularly shaped flat or plane surfaces 61, alternating with segmental-conical surfaces 62. The bore wall within the stem 55 is similarly configured, so that, as the bore progresses from its circular end at its juncture with the mouthpiece 12 to its rectangularly shaped end 57, the bore wall will gradually change from circular to rectangular. The reverse, of course, is true of each transition section 65. As a general rule it is preferred that the length of each of the stem and transition sections 55 and 65 equal at least three times the longest side of the rectangular bore (such as for example bore 57), which is formed at one end of the particular section.

When a "Y" fitting or manifold 54 of the type disclosed in FIGS. 2 and 3 is employed, an extremely efficient use of the energy imparted to the mouthpiece is achieved. Whenever air is forced through tubing, the energy loss and tone degradation depends on the interaction between the air and tubing surface, and the control of energy transfer along the air path. As the cross sectional area of an air path changes, there is a corresponding change in kinetic and potential energy of the air. Abrupt loss in kinetic energy is particularly critical in this application, and to avoid any such abrupt losses relatively long, smooth transitions are desired when the direction or diameter of an air passage is altered. It is therefore desirable that air passages proceed gradually with long tapered transitions as cross sectional areas increase, and then the passages split rapidly as the following cross sectional areas decrease.

Rectangularly shaped ducts or passages of the type embodied in the fitting 54 are advantageous since they permit rectangularly-shaped section splits (i.e., at the juncture of each "Y" connection), and such rectangular splits are far less loss-producing than circular section splits (i.e., as where a passage which is circular in cross section splits into two diverging passages which are also circular in cross section). The rectangular tubing or passages embodied in the fitting 54 thereby provide a significant difference in the preservation of the tone quality for the associated trumpets by minimizing the above-noted losses of kinetic and potential energy.

It is to be noted also that in all cases care should be taken to maintain as smooth as possible the manifold tubing or passages of the associated fittings 14 and 54, as well as the areas where the slides 44 are slidably connected to the legs of the loop formed in the tubing 28 of a given trumpet.

From the foregoing it will be apparent that the present invention provides a novel horn which permits a player, solely by application of proper lip vibrations to the mouthpiece 12, to play the entire chromatic trumpet range without the use of the manually-operable valves normally associated with trumpets. By connecting the tubes of each of seven different trumpets to a common mouthpiece, and by constructing each of the trumpets to represent one of seven different lengths corresponding to the seven semitones normally achievable by conventional trumpets, a unique horn has been produced. Each of the seven trumpets associated with a single mouthpiece may have its three valves replaced by a slide, such as that denoted at 44, which can be adjusted initially to place the overall length of the associated horn in a range corresponding to one of the seven effective horn lengths used for producing the above-noted semitones, or alternatively, each of such trumpets can be of the conventional variety having its valves secured in one of its seven different fingering positions. In practice the fitting 14 or 54, which connects the mouthpiece to the seven horns, is preferably made of a rigid plastic or metal material; and any conventional means may be employed, if desired, to fix against movement relative to each other the two sections of each trumpet tube 28 that are interconnected by the associated slide 44.

While this invention has been illustrated and described in connection with only certain embodiments thereof, it will be apparent that this application is intended to cover any such modifications as may fall within the scope of one skilled in the art or the appended claims.

What I claim is:

1. A musical wind instrument, comprising
a single mouthpiece,
a plurality of tubular trumpets, each of which has an axial bore having a predetermined, effective axial length different than that of the others, and
means connecting each of said trumpets to said mouthpiece for operation thereby solely by lip vibrations applied to said mouthpiece.

2. A musical wind instrument as defined in claim 1, wherein there are seven trumpets the approximate axial lengths of which are 54, 57.4, 61.1, 64.5, 68.4, 72.1 and 75.6 inches, respectively.

3. A musical instrument as defined in claim 1, wherein said connecting means comprises a tubular manifold having a tubular stem portion connected at one end to said mouthpiece and communicating at its opposite end through a plurality of divergent, tubular passages with the axial bores of each of said tubular trumpets.

4. A musical instrument as defined in claim 3, wherein the axial bores in said stem portion and said tubular passages are rectangular in cross section.

5. A musical instrument as defined in claim 4 wherein
the axial bores in said mouthpiece and said trumpets are circular in cross section,
said stem portion comprises a tubular transition section having an axial bore which is circular in cross section at said one end of stem portion and rectangular in cross section at said opposite end thereof, and each of said tubular passages is connected to the bore of its associated trumpet by a further transition section, which is rectangular in cross section at the end thereof that opens on said manifold, and circular in cross section on the end thereof which opens on the bore of its associated trumpet tube.

6. A musical instrument as described in claim 5, wherein the axial length of each of said transition sections is approximately three times the longest side of its rectangular bore.

7. A musical instrument as defined in claim 1, wherein each of said trumpets comprises a tubular member having a first section connected at one end to said manifold, a second section spaced from said section and having a bell-shaped configuration on one end thereof, and a generally U-shaped, tubular slide having its two legs slidably connected to the opposite ends of said first and second sections of said tubular member and slidably adjustable relative to said two sections selectively to increase or decrease the overall axial length of the associated trumpet.

8. A musical instrument as defined in claim 7, wherein each of said U-shaped slides has an axial length different from the other slides.

9. A musical instrument as defined in claim 1, wherein said stem portion opens at said opposite end thereof on a pair of said passages and axes of which intersect adjacent said opposite end of said stem portion and diverge therefrom approximately at an angle of 60° to each other.

10. A musical instrument as defined in claim 9, wherein the axis of each of said pair of passages is inclined at an angle of approximately 30° to the axis of said stem portion.

11. A musical instrument as defined in claim 10, wherein one of said pair of passages communicates adjacent its end remote from the stem portion with three of said trumpets, and the other of said pair of passages communicates adjacent its end remote from the stem portion with four of said trumpets.

12. A musical instrument as defined in claim 1, wherein the axes of the bores in said mouthpiece and manifold lie in a common plane.

13. A musical instrument comprising a tubular mouthpiece, a manifold having a single, tubular inlet connected to said mouthpiece, and a plurality of spaced, tubular outlets communicating at their inner ends with said inlet, and a plurality of tubular horns connected by said outlets to said mouthpiece for operation thereby, each of said horns comprising a first tubular section connected to one of said outlets, a second tubular section spaced from said first section, and a third tubular section adjustably interconnecting said first and second sections thereby to permit adjustment of the overall length of each horn.

14. A musical instrument as defined in claim 13, where said manifold has seven of said outlets connected to seven of said horns, and said horns have effective axial lengths from said mouthpiece of 54, 57.4, 61.1, 64.5, 68.4, 72.1 and 75.6 inches, respectively.

15. A musical instrument as defined in claim 13, wherein said second tubular sections are generally U-shaped in configuration.

* * * * *